US006186819B1

(12) United States Patent
Holub

(10) Patent No.: US 6,186,819 B1
(45) Date of Patent: Feb. 13, 2001

(54) LATCHING MECHANISM FOR A CONNECTOR

(75) Inventor: Franklin A. Holub, West Bloomfield, MI (US)

(73) Assignee: Cardell Corporation, Auburn Hills, MI (US)

( * ) Notice: Under 35 U.S.C. 154(b), the term of this patent shall be extended for 0 days.

(21) Appl. No.: 09/237,905

(22) Filed: Jan. 27, 1999

(51) Int. Cl.[7] ..... H01R 13/627
(52) U.S. Cl. ..... 439/358
(58) Field of Search ..... 439/358, 489, 439/488, 357, 350–356

(56) References Cited

U.S. PATENT DOCUMENTS

| | | |
|---|---|---|
| 4,361,375 | 11/1982 | Bailey et al. . |
| 4,370,013 | 1/1983 | Niitsu et al. . |
| 4,564,252 | 1/1986 | Kato et al. . |
| 4,708,413 | 11/1987 | Schroeder . |
| 4,711,511 | 12/1987 | Noorily . |
| 4,801,275 | 1/1989 | Ikeda et al. . |
| 4,940,430 | 7/1990 | Fujitani et al. . |
| 4,946,395 | 8/1990 | Cope et al. . |
| 4,963,103 | 10/1990 | Fink et al. . |
| 5,120,240 | 6/1992 | Reider . |
| 5,120,255 | 6/1992 | Kouda et al. . |
| 5,174,786 | 12/1992 | Kato et al. . |
| 5,203,718 | 4/1993 | Chishima . |
| 5,211,572 | 5/1993 | Comstock et al. . |
| 5,226,834 | 7/1993 | Kato et al. . |
| 5,234,356 | 8/1993 | Maejima et al. . |
| 5,292,258 | 3/1994 | Sakurai . |
| 5,330,369 | 7/1994 | Nozaki et al. . |
| 5,378,168 | 1/1995 | Sumida . |
| 5,628,648 | 5/1997 | Higgins, Jr. et al. . |
| 5,651,689 | 7/1997 | Plyler et al. . |
| 5,688,142 | 11/1997 | Dietz et al. . |
| 5,720,623 | 2/1998 | Polenick et al. . |
| 5,759,058 | 6/1998 | Childs et al. . |
| 5,830,002 * | 11/1998 | Ito et al. ..... 439/358 |

* cited by examiner

*Primary Examiner*—Steven L. Stephan
*Assistant Examiner*—Eugene G. Byrd
(74) *Attorney, Agent, or Firm*—Jones, Tullar & Cooper PC

(57) ABSTRACT

A latching mechanism and connector position assurance (CPA) system is provided for use with a two-part electrical connector having a first connector half which may be assembled to a second connector half. A raised stop is located on the first connector half, and the stop includes a ramp facing the second connector half during assembly of the first and second halves. A latch pocket is located on the second connector half, and the latch pocket includes an upperwall, a pair of sidewalls, and a deck. A latch member made of resilient metal is located within the latch pocket, and the latch member includes a latch arm having an aperture capable of receiving the raised stop. The latch arm is spring biased toward the deck, so that when the first connector half is assembled to the second connector half, the raised stop enters the aperture. The raised stop is retained within the aperture, and the first and second connector halves are thereby latched together. A CPA device is insertable into the latch pocket for contacting the latch and for preventing the latch arm from being raised to release said stop from said aperture. The CPA device can not be moved to the full forward position unless the connector halves are properly assembled and latched.

20 Claims, 7 Drawing Sheets

90
92
94
96
98
100
101
102
104
108
109
110
114
120

LATCHING MECHANISM FOR A CONNECTOR

FIELD OF THE INVENTION

The present invention generally relates to an electrical connector system, and, more particularly, to an improved latching system for an electrical connector which also provides connector position assurance when connecting two halves of an electrical connector.

BACKGROUND OF THE INVENTION

An electrical connector typically includes a pair of connector housing halves constructed from a dielectric material. The housing halves are usually identified as a plug half (or male half) and a socket half (or female half), with the two halves having complementary inter-engaging terminals for completing an electrical circuit when the housing halves are fully and properly mated. Electrical connectors normally require a secure mechanical and electrical engagement between the connector halves. Some prior art connector housings are relatively easy to separate or unmate, thereby disconnecting the electrical circuit. Obviously, inadvertent separation of a connector may cause malfunction of the equipment, and associated inconvenience, safety concerns, or the like.

To prevent unintentional separation of connector halves, a latching means is often included with the connector housing for holding the male and female connector halves in the engaged position. The latching means may also include a locking means to retain the connector in the latched position and to provide assurance to a person assembling the connector that the connector has been properly assembled, latched, and locked, and that the electrical connection is therefore complete. Such locking and indicating mechanisms are known in the art as connector position assurance ("CPA") devices. The CPA device may be separate from the latching mechanism, or may be integrated as part of the latch. Typically, the primary function of a CPA device is to indicate that the connector halves are fully mated and latched. A secondary function is often to prevent the latching mechanisms from inadvertently unlatching, thereby permitting the connector halves to separate.

Latching and CPA mechanisms have been accomplished in a wide variety of ways in the prior art. For example, U.S. Pat. No. 5,759,058, assigned to the same assignee as in the present application, discloses an electrical connector having two connector halves, with a latching mechanism and a CPA device. The latching mechanism includes a flexible arm on a first connector half and a shoulder on a second connector half. As the connector halves are assembled, the flexible arm engages with the shoulder for latching the connector halves together. Following latching of the connector halves, a CPA device may then be slid forward and snapped into a forward position. In this position, the CPA device prevents the flexible latching arm from disengaging from the shoulder, and the connector halves may not be unlatched. Further, if the connector halves are not properly mated, the CPA device is not able to slide into its proper forward position, thereby giving an indication of improper assembly of the connector halves.

While the foregoing latch and CPA mechanisms function effectively for the intended applications, the components can be relatively bulky. The components are typically molded from plastic, and, thus, must be sufficiently thick to perform their intended function without cracking or breaking. Further, the latching mechanism is typically molded integrally with the connector housing, thereby complicating the molding process for the housing. Accordingly, it is desirable to provide a connector latching and CPA mechanism whose functional components are not molded integrally with the connector housing. It is further desirable to provide a CPA and latching mechanism whose functional components enable a lower profile and more compact construction than those of the prior art, without sacrificing strength and functionality. The latching mechanism and CPA device of the present invention provide these and other benefits, and overcome the shortcomings associated with the prior art.

SUMMARY OF THE INVENTION

In the preferred form of the invention, a connector includes a first housing half and a second housing half, with one of the connector halves being a socket half, and the other connector half being a plug half. A latching mechanism is provided so that as the connector halves are assembled, they are latched in the assembled position. A CPA device is also provided so that following latching of the connector halves in the assembled condition, the CPA device may be slid forward to lock the latching mechanism to prevent the connector from being inadvertently unlatched. If the connector halves are not properly assembled, it is not possible to slide the CPA device into the forward position. Further, for disassembling the connector, the CPA device may be manually slid back from the locked position to the unlocked position, and the latch manually unlatched so that the connector halves may be unmated.

Also in a preferred form of the invention, the functional components of the latching mechanism and CPA device are fabricated from a resilient metal such as stainless steel. The use of resilient metal for the components takes advantage of the greater elastic memory of metal relative to plastic, and also takes advantage of the greater strength of metal relative to plastic. Accordingly, the functional components may be constructed much thinner and more compact than those in the prior art. This allows a low profile latch and CPA mechanism, and also allows the connector housing to be made more compact than in the prior art.

The latching mechanism of the present invention includes a resilient metal latch member which is constructed separately, and then installed into one half of the connector housing. The latch member is retained in a latch pocket formed integrally with the connector housing. The latch member includes a forwardly-extending latch arm, comprised of a pair of parallel bars, with a folded crossbeam connecting the distal ends of the bars. The parallel bars and crossbeam create an open area or aperture in the latch arm, so that a raised stop located on the other connector half may enter the aperture and be retained by the crossbeam. The latch member also includes a centrally located forwardly-extending spring arm which biases the latch arm against the lower surface of the connector housing, but which enables the latch member to be pivoted about a fulcrum point. A finger lever is provided proximally on the latch member, and may be pressed down manually for raising the crossbeam, and thereby unlatching the latch member.

The present invention also includes a CPA device for locking the latch mechanism in the latched position. The CPA device is also constructed from resilient metal, and is retained within the latch pocket in a pair of opposed parallel grooves located in the sidewalls of the latch pocket. The grooves enable the CPA device to be slid forward to engage and lock the latch member. The CPA device includes a centrally located flexible arm having a distal securing member. The proximal portion of the CPA device includes a main body, an upwardly extending push area, and a pair of sidewardly extending wings for engaging with the grooves of the latch pocket. Following mating and latching of the connector halves, the CPA device is pushed forward so that the distal securing member rides over the raised stop and the crossbeam on the latch member, and then snaps down in front of the crossbeam so that the CPA device is secured in the forward position. The CPA device also includes a pair of raised bumps on the main body. If the finger lever of the latch member is pressed downward, projections extending downward from the proximal end of the latch member contact the raised bumps, thereby stopping the downward movement. This prevents the cross beam from being raised so that unlatching of the connector is prevented.

Thus, the present invention provides a low profile, compact, high strength, and ergonomic latching and CPA mechanism for use with an electrical connector or the like. Further, while the preferred embodiment of the invention will be described in conjunction with an electrical connector for a wiring harness or the like, it may be equally well used with other latchable connectors, and is not limited to electrical connectors.

BRIEF DESCRIPTION OF THE DRAWINGS

The foregoing and additional objects, features, and advantages of the present invention will become apparent to those of skill in the art from a consideration of the following detailed description of a preferred embodiment of the invention, taken in conjunction with the accompanying drawings.

DETAILED DESCRIPTION

Figure 1:
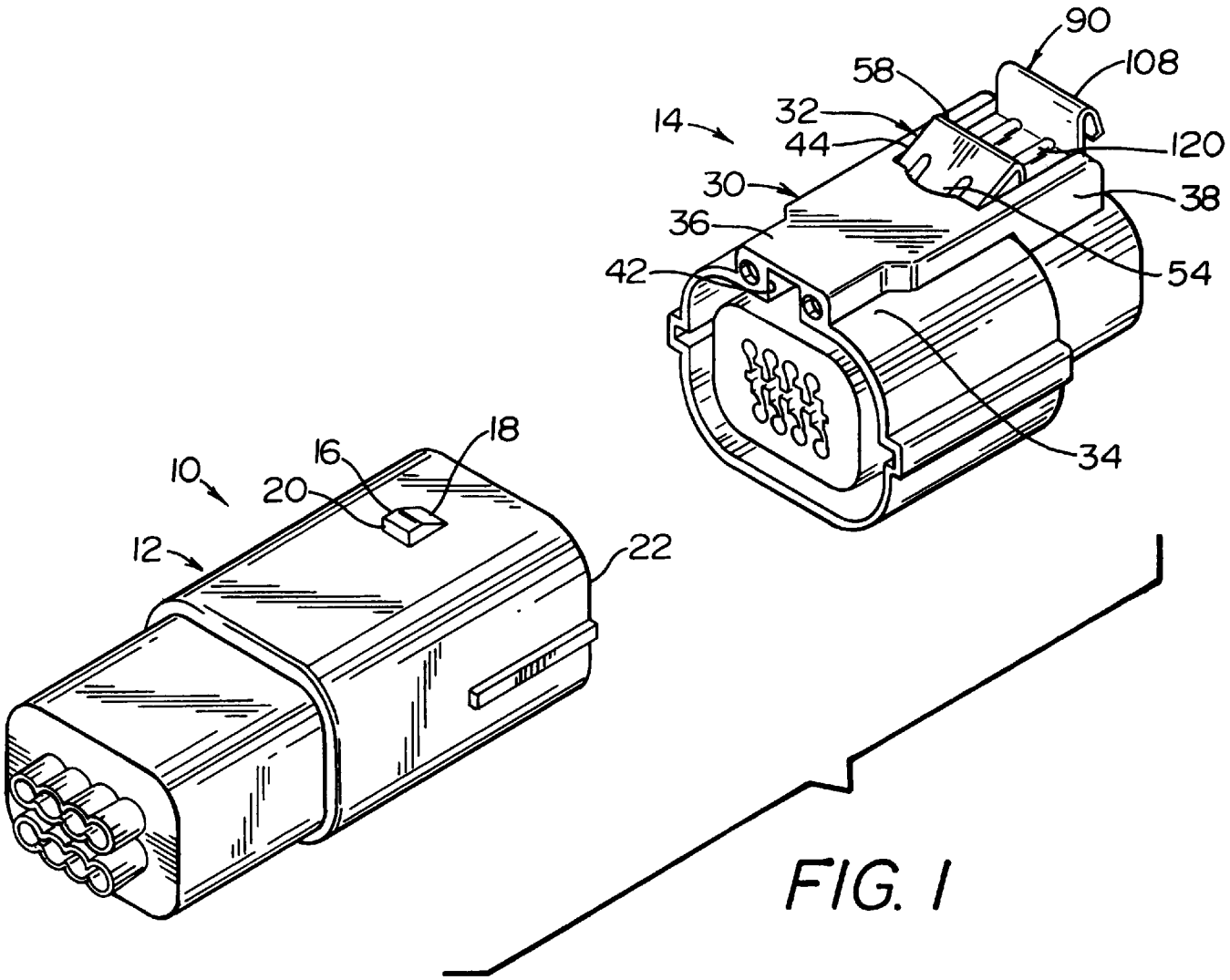
FIG. 1 is a perspective view of an electrical connector having first and second connector halves in accordance with the preferred embodiment of the present invention.
Figure 2A:
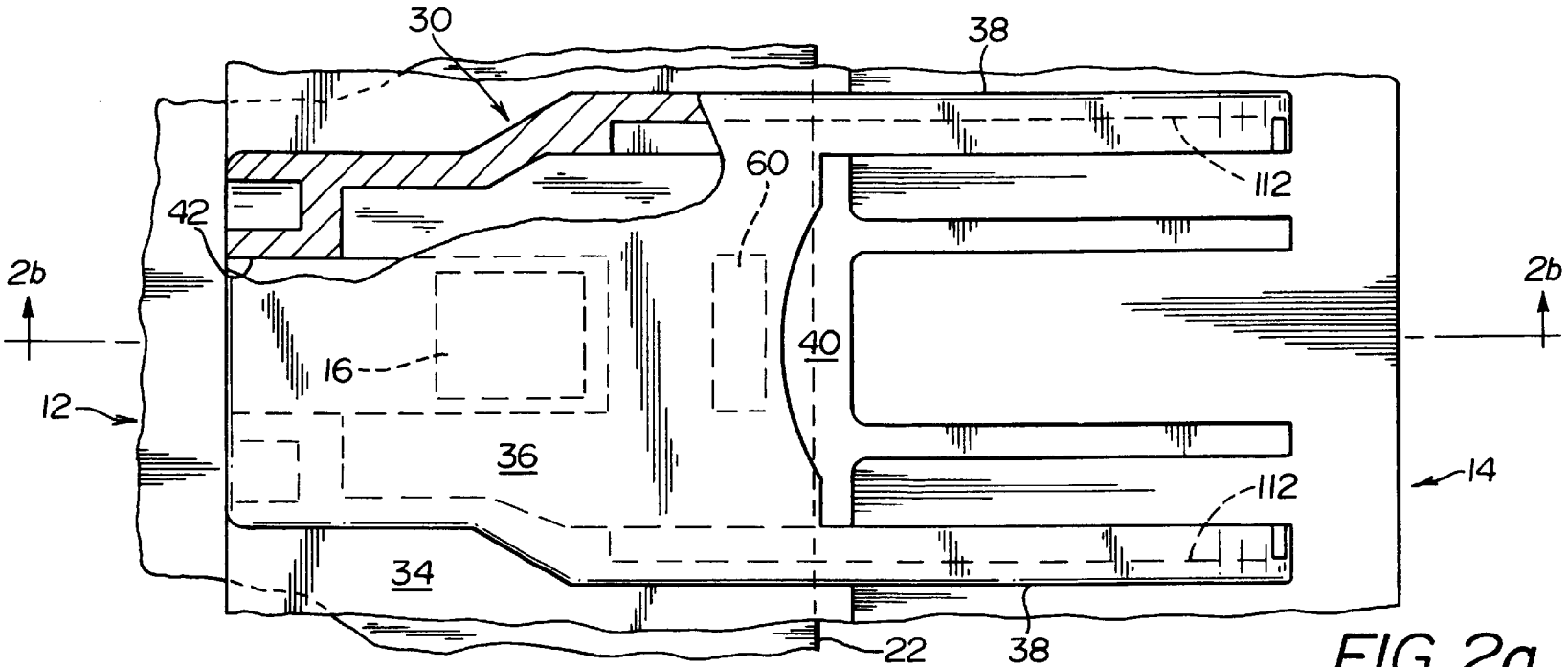
FIG. 2*a* is an enlarged plan view of the latch pocket of FIG. 1, with the first connector half assembled to the second connector half, and with the latch member and CPA device removed for clarity.
Figure 2B:
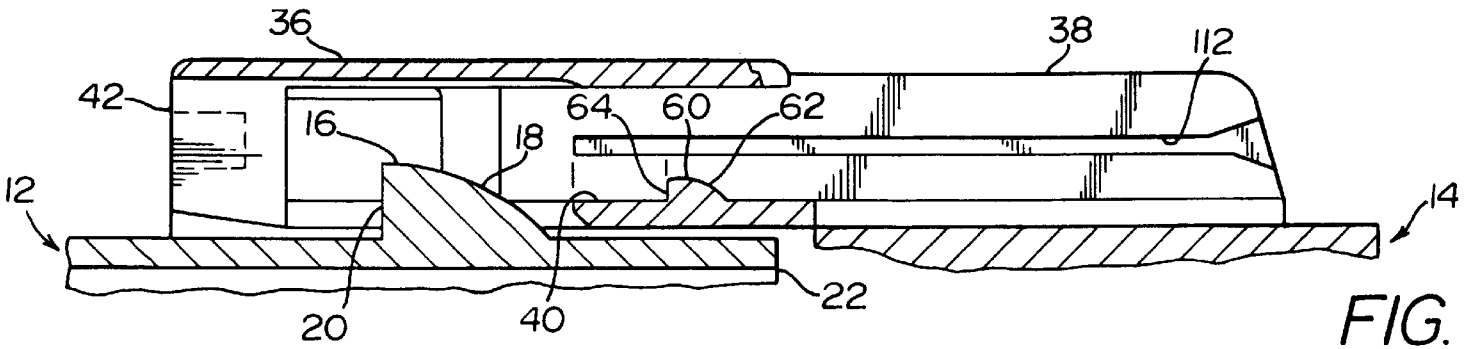
FIG. 2*b* is a view of the latch pocket of FIG. 2*a* taken along line 2*b*—2*b*.
Figure 3A:
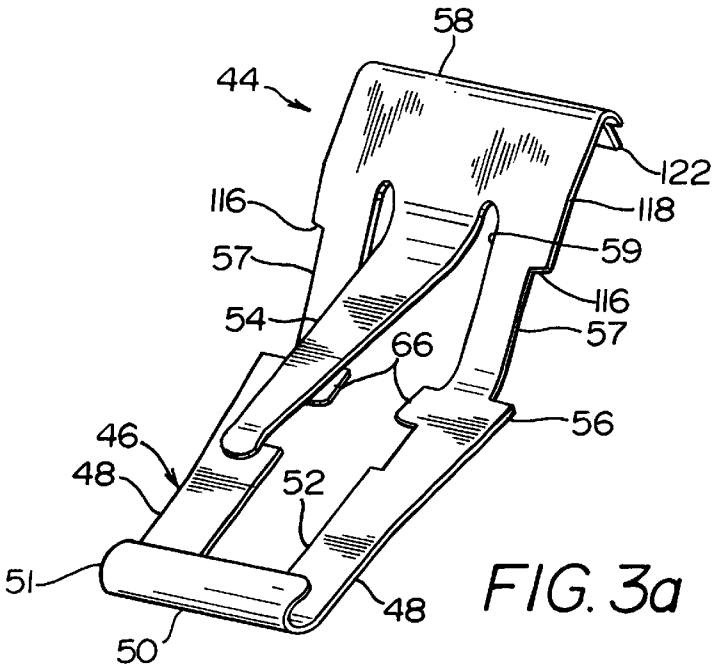
FIG. 3*a* is an enlarged perspective view of a latch member of the present invention.
Figure 3E:
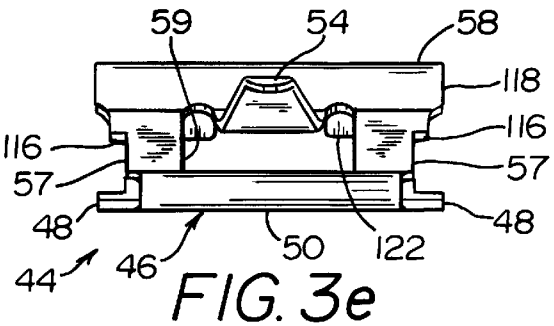
FIG. 3*e* is a right end view of the latch member of FIG. 3*b*.
Figure 3B:
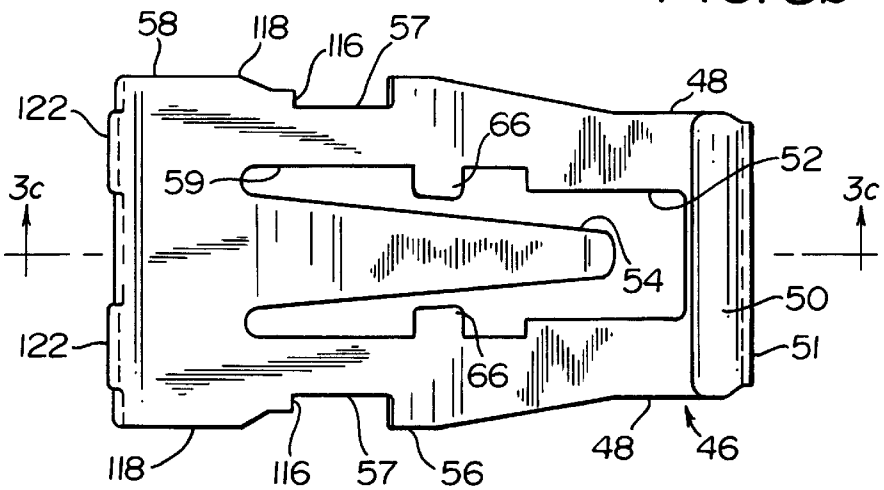
FIG. 3*b* is a plan view of the latch member of FIG. 3*a*.
Figure 3C:
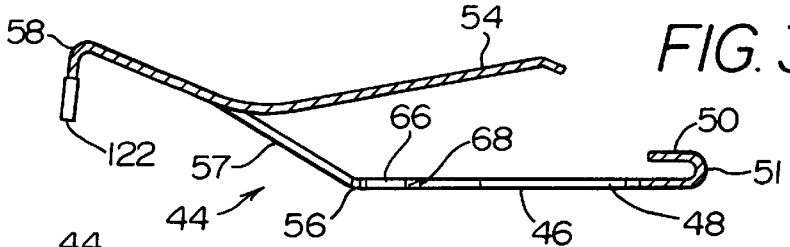
FIG. 3*c* is a cross section view of the latch member of FIG. 3*b* taken along line 3*c*—3*c*.
Figure 3D:
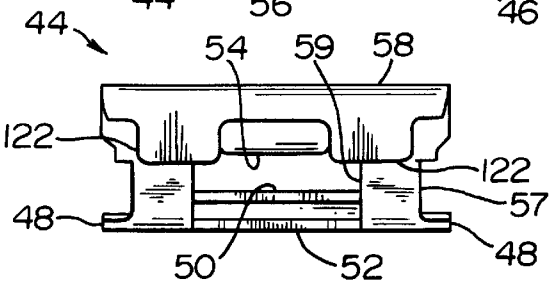
FIG. 3*d* is left end view of the latch member of FIG. 3*b*.

Turning now to a more detailed description of the present invention, there is illustrated in FIG. 1 an electrical connector 10 in accordance with the present invention. Connector 10 includes a first connector half 12 and second connector half 14. First connector half 12 and second connector half 14 are constructed so as to interfit in a mating configuration for making an electrical connection. Connector 10 may be appropriately shaped or configured for any intended connector application, and, thus, the particular configuration of connector halves 12, 14, is not critical to the invention. Accordingly, the invention may be used with any type of interfitting connectors, and the invention is not limited to the particular arrangement shown.

First connector half 12 includes a raised stop 16 on the exterior of its upper surface. Raised stop 16 includes a ramp side 18 and a shoulder side 20. Ramp side 18 faces the mating end 22 of first connector half 12 to facilitate latching of the connector halves 12, 14, as will be described below. Connector halves 12, 14, may be constructed of any suitable material, but preferably are constructed of a dielectric thermoplastic so that injection molding may be used for the manufacturing of connector 10.

Second connector half 14 includes a latch pocket 30 for containing a latching mechanism 32. As also illustrated in FIGS. 2*a*–2*d*, latch pocket 30 is a tunnel-like portion located on the outer surface 34 of second connector half 14. Latch pocket 30 is preferably formed integrally with second connector half 14 during molding, but may be attached or formed during a subsequent process. Latch pocket 30 includes an upper wall 36, a pair of side walls 38, and a lower deck 40. Lower deck 40 is formed as a portion of outer surface 34 of second connector 14. Latch pocket 30 also includes a forward opening 42 for receiving raised stop 16 when first connector half 12 is assembled to second connector half 14.

Referring to FIG. 1, latch mechanism 32 includes a latch member 44 retained within latch pocket 30. Latch member 44 is formed of a resilient metal, such as stainless steel, and may be constructed by die stamping and forming, or the like. As illustrated in FIGS. 3*a*–3*e*, latch member 44 includes a forwardly extending latch arm 46 having a pair of parallel, generally mirror image latch bars 48 connected distally by a folded crossbeam 50. This configuration creates an open area or aperture 52 which receives and retains raised stop 16 when first connector half 12 is assembled to second connector half 14, as illustrated in FIGS. 4*a* and 4*b*.

Latch member 44 also includes a forwardly extending spring arm 54 which bears against upper wall 36 of latch pocket 30 when latch member 44 is installed within latch pocket 30. Spring arm 54 creates a bias against latch arm 46, thereby pressing latch arm 46 against deck 40. Thus, spring arm 54 helps retain latch member 44 within latch pocket 30, while also allowing latch member 44 to pivot about a fulcrum point 56. Spring arm 54 is mounted on, and extends from a finger lever 58 which is provided proximally on latch member 44. Finger lever 58 is joined to latch arm 46 at fulcrum point 56, and extends away from latch arm 56 at an oblique angle. Pressing downward on finger lever 58 causes latch member 44 to be pivoted about fulcrum point 56, thereby raising latch arm 46 upward for unlatching latch member 44 from raised stop 16. Finger lever 58 is advantageously formed having a pair of legs 57 with a passage 59 formed therethrough. Passage 59 permits passage of a CPA device, as will be described in more detail below.

Figure 4A:
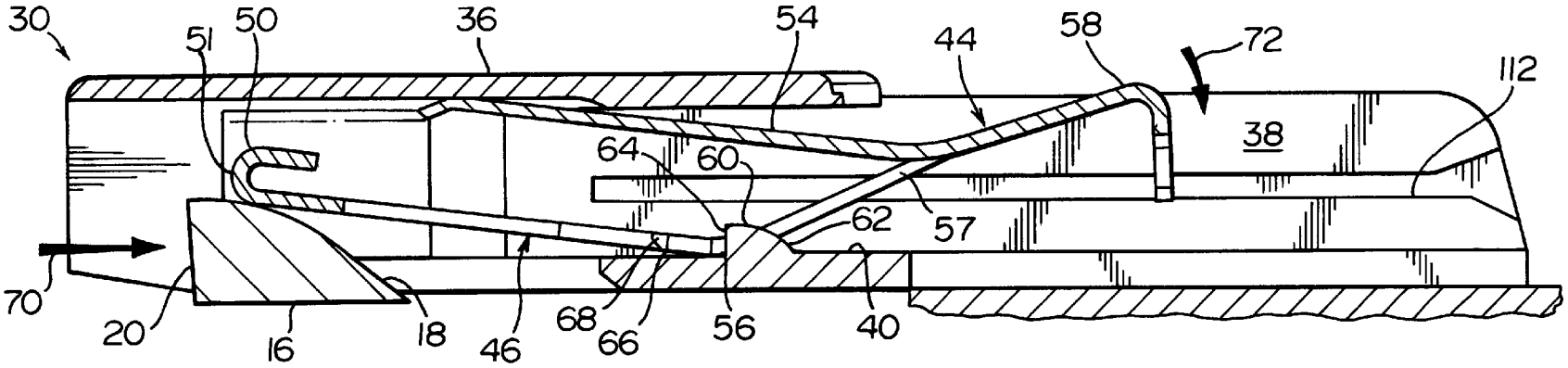
FIG. 4*a* is an enlarged cross section view showing first connector half 12 being assembled to second connector half 14, with the latch member installed.
Figure 4B:
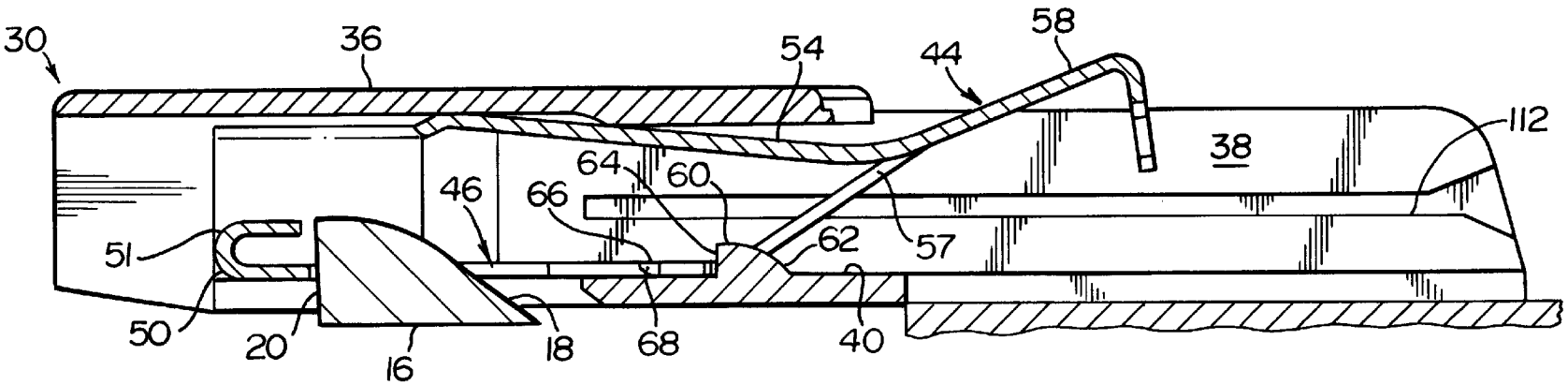
FIG. 4*b* shows the first and second connector halves 12, 14 of FIG. 4*a* in the fully assembled and latched position.
Figures 5A, 5B, 5C, 5D:
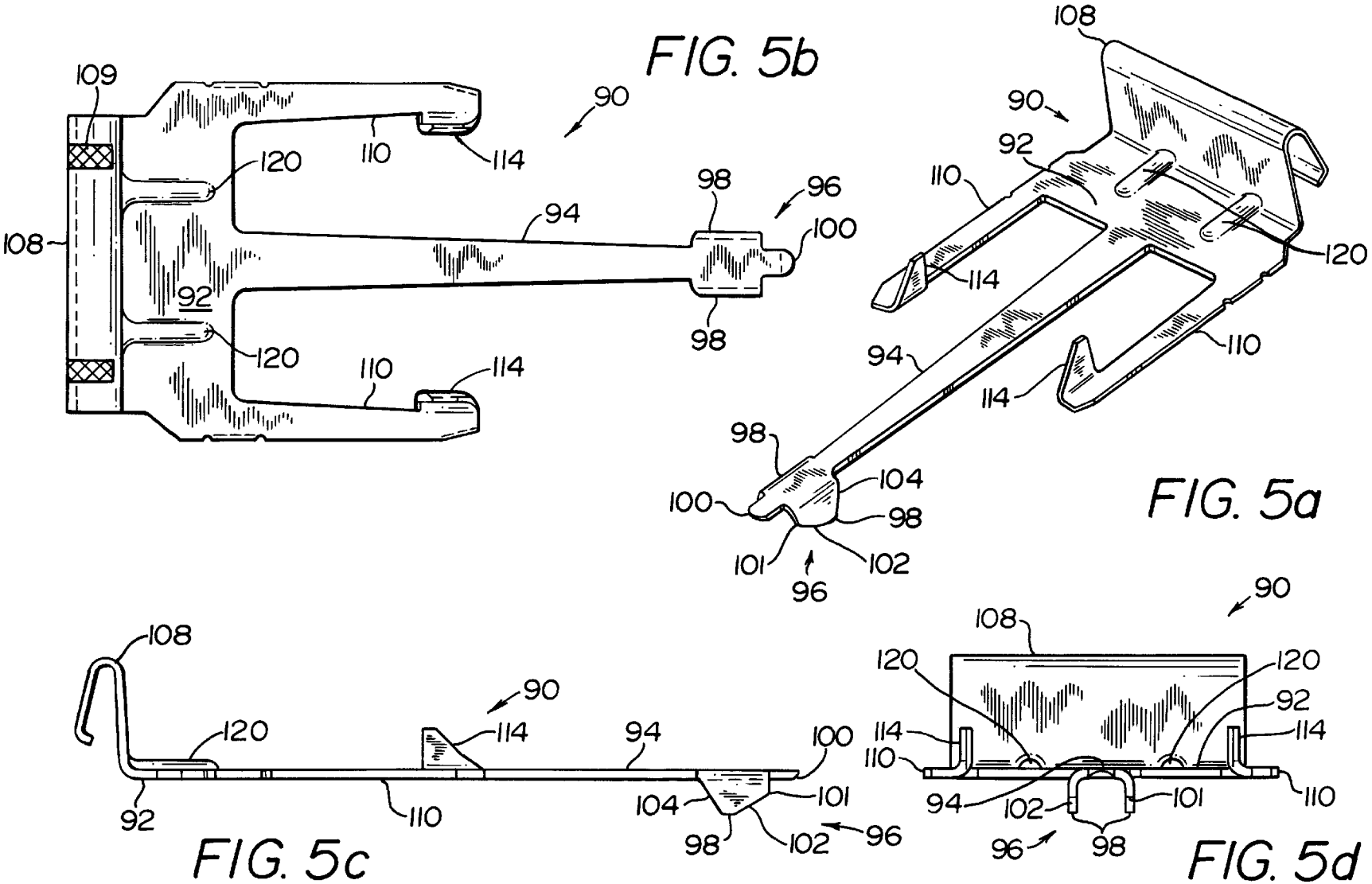
FIG. 5*a* shows an enlarged perspective view of the CPA device of the present invention.
FIG. 5*b* shows a plan view of the CPA device of FIG. 5*a*.
FIG. 5*c* shows an elevation view of the CPA device of FIG. 5*b*.
FIG. 5*d* shows a right end view of the CPA device of FIG. 5*c*.

As illustrated in FIGS. 4*a* and 4*b*, latch member 44 is retained within latch pocket 30 by a transverse ramped projection 60 formed on the surface of deck 40. Projection 60 is formed with a ramp 62 to enable latch member 44 to slide into latch pocket 30, while a projection shoulder 64 is formed on the opposite side of projection 60 for retaining latch member 44. Latch member 44 has retaining tabs 66 formed on latch bars 48, and projecting inwardly into aperture 52. When latch member 44 is inserted into latch pocket 30, retaining tabs 66 snap over ramped projection 60, and bear against shoulder 64 for preventing removal of latch member 44 from latch pocket 30. The spring bias of spring arm 54 keeps tabs 66 from rising up over projection 60. Retaining tabs 66 may further include a beveled forward edge 68 to facilitate the insertion of latch member 44 into latch pocket 30.

The function of latching mechanism 32 during assembly of connector 10 is illustrated in FIGS. 4*a* and 4*b*. As first connector half 12 is mated to second connector half 14, raised stop 16 encounters folded crossbeam 50 of latch member 44. Movement of raised stop 16 in the mating direction (indicated by arrow 70) causes crossbeam 50 to ride up ramp side 18 of stop 16, causing latch member 44 to pivot about fulcrum point 56 against the spring force of spring arm 54, as shown in FIG. 4*a*. As crossbeam 50 clears the end of raised stop 16, and stop 16 enters aperture 52, spring arm 54 forces latch arm 46 back toward deck 40. This creates an audible snapping or clicking noise, and traps stop 16 within aperture 52. First connector half 12 is prevented from being disconnected from second connector half 14 by shoulder side 20 of stop 16 bearing against crossbeam 50. However, the connector halves 12, 14 may be disconnected by manually pressing finger lever 58 in the direction of arrow 72, which causes crossbeam 50 to rise a sufficient distance to allow raised stop 16 to be withdrawn underneath crossbeam 50, and the connector halves 12, 14 may then be disconnected. It will also be apparent that the folded configuration of crossbeam 50 is advantageous because of a forwardly formed radius 51 which ensures that cross beam 50 rides up ramp 18 more smoothly and easily.

From the foregoing it will be apparent that there is provided a novel latching mechanism which enables the two connector halves to be securely engaged and latched. The latching mechanism is more compact and lower in profile than conventional latching systems, enabling the manufacture of smaller connectors. In addition, because the latching member is of metal, the latch is of high strength, and may be repeatedly latched and unlatched without concern over material fatigue, unlike many plastic latching mechanisms of the prior art. Accordingly, the latching mechanism of the present invention provides a substantial advantages over those of the prior art.

Furthermore, it should be noted that the latching function of latch mechanism 32 is separate from the flexing or spring function. Thus, latch arm 46 is relatively stiff compared to spring arm 54. This enables latch arm 46 and finger lever 58 to pivot about fulcrum point 56 as a single unit during latching and unlatching of latch mechanism 32. Spring arm 54 provides a separate bias to force latch arm 46 toward the latched position. This produces a unique pivoting latching and unlatching action which is an additional advantage over the prior art latching mechanisms which use a single beam for both the latching and flexing function.

Following assembly of connector halves 12, 14, in order to ensure that latching mechanism 32 is properly latched and will not become inadvertently unlatched, a connector position assurance ("CPA") device may be provided. FIGS. 5*a*–5*d* illustrate a CPA device 90 of the present invention. CPA device 90 is preferably constructed from resilient metal, such as stainless steel, and is slidably mounted in latch pocket 30, generally proximally of latch member 44. CPA device 90 includes a generally planar main body 92 with an elongate, forwardly-extending, centrally located flexible arm 94 projecting in a generally coplanar fashion from main body 92. When CPA device 90 is assembled into latch pocket 30, flexible arm passes through passage 59 in finger lever 58, between spring arm 54 and latch arm 46.

A distal securing member 96 is located on the distal end of flexible arm 94, and includes a pair of downwardly extending folds 98 and a beveled tip 100. Downwardly extending folds 98 project downward from flexible arm 94 at approximately 90 degrees, and include a forward edge 101, a forward slope 102, and a rear slope 104. Forward edge 101 serves to prevent the CPA device from being moved to the forward position if connector halves 12, 14 are not properly assembled. For example, if CPA device 90 is pushed forward when raised stop 16 is not located within aperture 52, forward edge 101 will contact folded cross beam 50, and further forward movement of CPA device 90 will be prevented. This will provide a visual indication that the connector halves 12, 14 are not properly assembled. Furthermore, if crossbeam 50 is located over top of stop 16, in the position illustrated in FIG. 4*a*, then forward edge 101 will also prevent CPA device 90 from being moved to the full forward position. However, if latch member 44 is properly latched, then, when CPA device 90 is pushed forward, forward slopes 102 on folds 98 will enable securing member 96 to ride up the ramp side of stop 16, and over crossbeam 50 to the full forward and locked position illustrated in FIG. 6*b*. Rear slope 104 on folds 98 enables CPA device 90 to be moved back to the rearward and unlocked position under the application of sufficient rearward force. Thus, CPA device 90 provides assurance of a proper assembly of the connector halves 12,14 when CPA device 90 is in the full forward position. Further, with application of sufficient force, CPA device 90 may be moved from the locked to the unlocked position so that the connector halves 12, 14 may be unlatched, if such action is desired.

Figure 7:
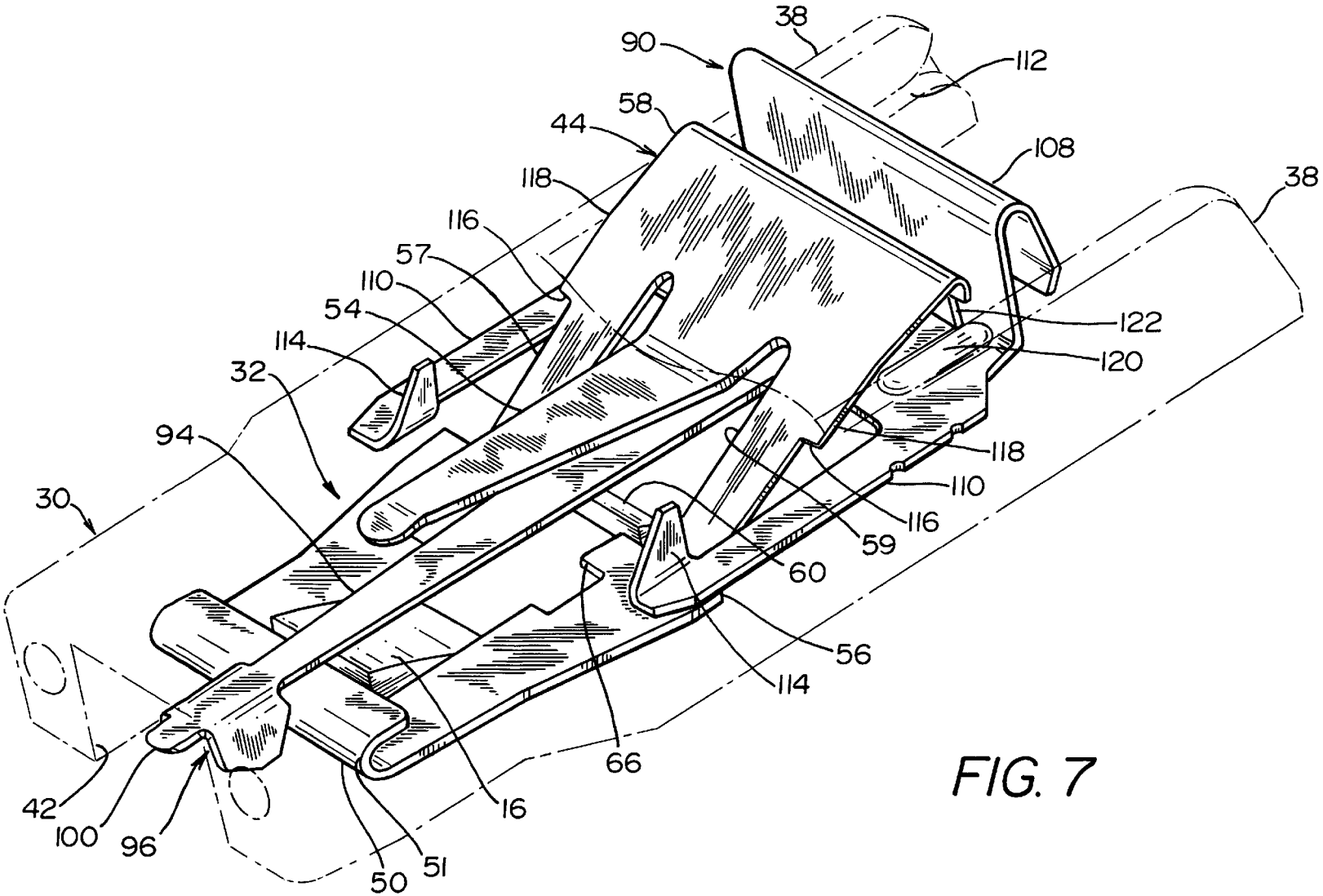
FIG. 7 is a perspective view of the invention in the condition shown in FIG. 6*b*, with the latch pocket shown in phantom for clarity.

The proximal portion of CPA device 90 includes an upwardly extending push button 108, and a pair of sidewardly extending elongate wings 110. Push button 108 may include a knurled surface 109, and is used to push CPA device 90 forward or pull CPA device rearward within latch pocket 30. Wings 110 slidably engage with a pair of opposed, parallel grooves 112 located in side walls 38 of latch pocket 30 when CPA device 90 is inserted into latch pocket 30. Wings 110 include upwardly-extending fins 114 which are generally triangular, and which extend upward from wings 110 at a generally 90 degree angle. Fins 114 serve to retain CPA device 90 in the latch pocket after assembly of the CPA device and latch mechanism into latch pocket 30, but prior to mating of the connector halves and locking of the latch mechanism. As illustrated in FIG. 7, latch member 44 includes a side cutout 116 on each outer edge 118 of finger lever 58. Although the CPA device 90 shown in FIG. 7 is in the full forward and locked position, it will be apparent that if CPA device 90 is drawn rearward to the unlocked position, fins 114 will engage with cutouts 116 on latch member 44, thereby halting rearward movement of CPA device 90. Thus, fins 114, combined with cutouts 116 serve to retain CPA device 90 with the latching mechanism so that it does not become disjoined from connector 10.

Figure 6A:
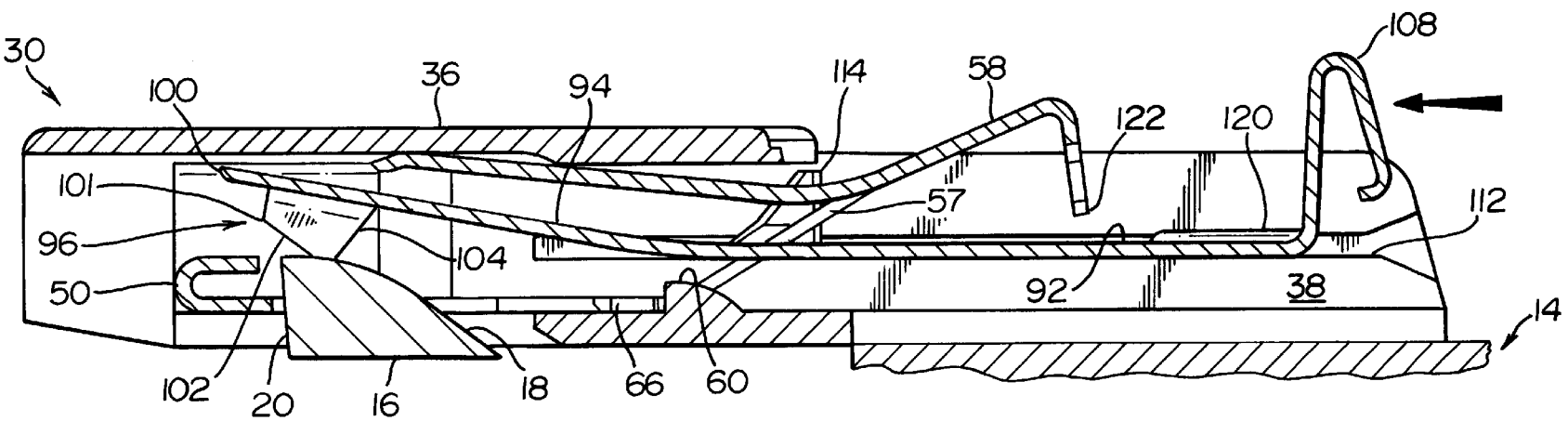
FIG. 6*a* shows the view of FIG. 4*b*, with the CPA device being pushed forward to the locking position.
Figure 6B:
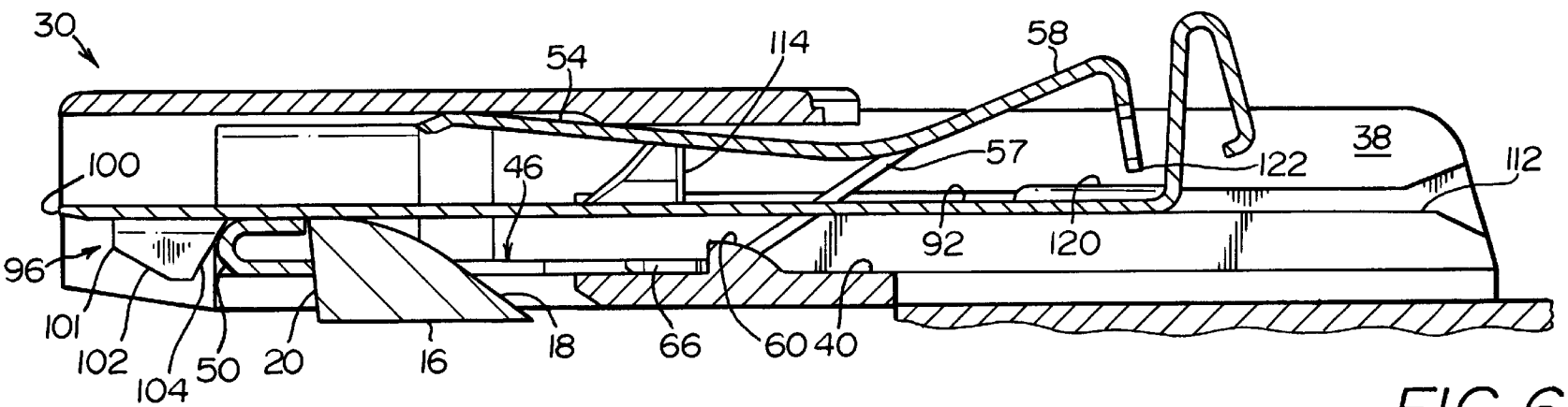
FIG. 6*b* shows the view of FIG. 6*a* with the CPA device in the full forward and fully locked position.

In use, following mating and latching of the connector halves 12, 14, as described above, CPA device 90 is pushed forward to so that distal securing member 94 rides up and over ramp side 18 of raised stop 16, and then over crossbeam 50 of latch member 44. As illustrated in FIGS. 6*b* and 7, distal securing member 96 then snaps down in front of crossbeam 50 thereby securing CPA device 90 in the full forward position. The resilience of flexible arm 94 also acts against the raising of crossbeam 50, and downward projecting folds 98 generally prevent CPA device 90 from being drawn back by minor force.

To prevent unlatching of latch member 44 when CPA device 90 is in the full forward position, CPA device main body portion 92 includes a pair of elongate, parallel, raised indentations or bumps 120 which are formed on the upper surface of main body portion 92. Bumps 120 prevent depression of finger lever 58, because if such depression occurs, bumps 120 will contact a pair of downwardly extending projections 122 located on the proximal end of finger lever 58 of latch member 44. This contact between bumps 120 and projections 122 will occur before crossbeam 50 can be raised a sufficient distance to release raised stop 16. Thus, CPA device 90 will prevent unlatching of latch 44 once CPA device 90 is moved to the full forward and locked position, as illustrated in FIGS. 6*b* and 7.

From the foregoing, it will be apparent that CPA device 90 of the present invention provides a secure and simple means for locking the latching mechanism 32 of the invention. Since CPA device 90 cannot be moved to the full forward position unless the connector 10 is properly assembled and latched, CPA device 90 provides assurance of proper connection between connector halves 12, 14 when CPA device 90 is in the forward position. Furthermore, CPA device 90 prevents unintentional unlatching of the latch mechanism by preventing latch 44 from being depressed far enough to release stop 16. However, CPA device 90 may be removed upon the application of sufficient rearward force to enable unlatching of latch mechanism 32 and disconnection of the connector halves 12, 14.

Although the present invention has been described in terms of preferred embodiments, it will be apparent that variations and modifications may be made without departing from the true spirit and scope thereof, as set forth in the following claims.

What is claimed is:

1. In combination, a latching mechanism and a connector, comprising:

a first connector half connectable to a second connector half;

a raised stop located on said first connector half, said stop having a ramp facing said second connector half during mating of the first and second halves;

a latch pocket located on said second connector half, said latch pocket having an upperwall and a pair of sidewalls; and a latch member located within said latch pocket, said latch member having a latch arm, said latch arm having an aperture therein capable of receiving said raised stop, said latch arm further being spring biased away from said upperwall by a spring arm, whereby, when said first connector half is assembled to said second connector half, said latch arm rides up said ramp of said raised stop so that said raised stop enters said aperture, and said spring bias forces said latch arm back away from said upperwall so that said raised stop is retained within said aperture and said first and second connector halves are thereby latched together.

2. The latching mechanism of claim 1 wherein said latch member includes a finger lever connected to said latch arm at an oblique angle, said spring arm projecting from said finger lever and contacting said upperwall of said latch pocket for biasing said latch arm away from said upperwall.

3. The latching mechanism of claim 2 wherein the outer surface of said second connector half forms a deck of said latch pocket, and wherein a projection is formed transversely on said deck, and further wherein, a pair of tabs extend inwardly from said latch arm into said aperture, said tabs contacting said projection for retaining said latch member within said latch pocket.

4. The latching mechanism of claim 2 wherein said finger lever is at an oblique angle relative to said latch arm so that a fulcrum point is formed where said finger lever joins said latch arm for enabling said latch arm to be raised by manually pressing down on said finger lever.

5. The latching mechanism of claim 1 further including a CPA device insertable into said latch pocket for contacting said latch and for preventing said latch arm from being raised to release said stop from said aperture.

6. The latching mechanism of claim 5 wherein said CPA device includes a flexible arm extending from a planar main body, said flexible arm having a distal securing member which prevents movement of said CPA device to the full forward position if said latch member is not properly latched.

7. The latching mechanism of claim 6 wherein said CPA device includes a planar main body having at least one raised bump and said latch member includes at least one downward projection, whereby if an attempt is made to unlatch said latch member when said CPA device is in the full forward position, said downward projection will contact said raised bump for preventing such unlatching.

8. A latching mechanism for securing two halves of a connector housing having a first connector half mateable to a second connector half, said mechanism comprising:

a raised stop located on the first connector half;

a latch pocket located on the second connector half having a tunnel-like configuration with an upper surface and a lower surface; and a latch member constructed of resilient metal retained in said latch pocket, said latch member having a latch arm for engaging with said raised stop when said first connector half is assembled to said second connector half, said latch member further having an integral spring arm, which is formed to engage the upper surface and thereby biases said latch arm to prevent disengagement of said raised stop from said latch arm when said first and second connector halves are assembled.

9. The latching mechanism of claim 8 wherein said latch member includes a finger lever connected to said latch arm, with said spring arm projecting from said finger lever for contacting said upper surface of said latch pocket for biasing said latch arm against said lower surface of said latch pocket.

10. The latching mechanism of claim 9 further including a projection on said lower surface of said latch pocket, and a pair of tabs on said latch member, said tabs extending inwardly into said aperture, said tabs contacting said projection for retaining said latch member within said latch pocket.

11. The latching mechanism of claim 8 further including a CPA device insertable into said latch pocket for contacting said latch member and for preventing said latch arm from being raised to release said raised stop from engagement with said latch arm.

12. The latching mechanism of claim 11 wherein said CPA device is constructed of resilient metal, and includes a flexible arm extending from a planar main body, said flexible arm having a distal securing member which prevents movement of said CPA device to the full forward position if said latch member is not properly latched.

13. The latching mechanism of claim 11 wherein said CPA device includes a planar main body having at least one raised bump and said latch member includes at least one downward projection, whereby if an attempt is made to unlatch said latch member when said CPA device is in the full forward position, said downward projection will contact said raised bump for preventing such unlatching.

14. The latching mechanism of claim 12 wherein said finger lever includes a passage which enables said flexible arm of said CPA device to pass between said spring arm and said latch arm.

15. A latch mechanism combined with a connector, the connector having a first connector half mateable with a second connector half, said combination comprising:

a raised stop on the first connector half;

a tunnel-like portion formed on the second connector half for receiving a resilient metal latch member, said latch member being insertable into the tunnel-like portion and being retained therein prior to the mating of the first connector half with the second connector half; and said latch member having a latch arm, said latch arm including a crossbeam for engaging with said raised stop to latch the first connector half to the second connector half when the two halves are mated.

16. The combination of claim 15 further including a finger lever connected to said latch arm at an oblique angle whereby a fulcrum point is formed where said latch arm joins said finger lever for enabling said latch member to pivot at said fulcrum point.

17. The combination of claim 16 further including a spring arm projecting from said finger lever for biasing said latch arm into a latching position.

18. The combination of claim 15 in which said latch member includes retaining tabs for engaging with projections located within the tunnel-like portion for retaining the latch member in the tunnel-like portion.

19. The combination of claim 15 further including a CPA device insertable into said tunnel-like portion following mating of the first connector half with the second connector half for preventing said latch member from being unlatched.

20. The combination of claim 17 further including a CPA device and in which said finger lever includes a passage for allowing the CPA device to be inserted between said spring arm and said latch arm following mating of the first connector half to the second connector half, whereby insertion of said CPA device serves as an indicator that the latch mechanism is properly latched.

* * * * *